US006322231B1

(12) United States Patent
Parsons et al.

(10) Patent No.: US 6,322,231 B1
(45) Date of Patent: Nov. 27, 2001

(54) FLASHLIGHT HAVING IMPROVED VIBRATION RESISTANCE

(75) Inventors: Kevin L. Parsons, Appleton, WI (US); W. Clay Reeves, Dallas, TX (US)

(73) Assignee: Armament Systems Procedures, Inc., Appleton, WI (US)

( * ) Notice: Subject to any disclaimer, the term of this patent is extended or adjusted under 35 U.S.C. 154(b) by 0 days.

(21) Appl. No.: 09/583,834

(22) Filed: May 31, 2000

(51) Int. Cl.[7] ..... F41G 1/34
(52) U.S. Cl. ..... 362/110; 362/369; 362/208
(58) Field of Search ..... 362/110, 205, 362/208, 202, 390, 306, 369

(56) References Cited

U.S. PATENT DOCUMENTS 4,313,272 2/1982 Matthews .
4,740,876 * 4/1988 Roller ..... 362/390
4,856,218 8/1989 Reyolds, Jr. .
5,601,359 * 2/1997 Sharrah ..... 362/204

* cited by examiner

*Primary Examiner*—Alan Cariaso
*Assistant Examiner*—Hargobind S. Sawhaney
(74) *Attorney, Agent, or Firm*—Robert F. I. Conte; Lee, Mann, Smith, McWilliams, Sweeney & Ohlson

(57) ABSTRACT

A flashlight including a housing with an internal groove, a contact spring resting within the groove, a lamp assembly disposed within the housing, and a power source in electrical contact with the housing. The contact spring provides an electrical contact between the housing and the lamp assembly.

21 Claims, 4 Drawing Sheets

FLASHLIGHT HAVING IMPROVED VIBRATION RESISTANCE

FIELD OF INVENTION

The invention is generally related to light emitting devices and is more specifically directed to flashlights having improved vibration resistance.

BACKGROUND OF INVENTION

Law enforcement and military personnel commonly use flashlights and lasers. In use, they may be exposed to harsh operating conditions, including subjection to a great deal of vibration. For example, swat teams, military units, and Special Forces often use lights in the form of flashlights, scopes, laser guidance systems, and other light sources (collectively referred to herein as "flashlights") attached to firearms such as high powered automatics, rifles, and submachine guns. Weaponry with attached light sources are often used during hostage situations, terrorist suppression, and combat to improve visibility typically found in dark, foggy, smoky, or other low visibility settings. It is desirable for these light sources to provide an uninterrupted source of light when subjected to vibration. For instance, a light attached to a firearm experiences immense vibration during firing which may cause the light to flicker. In the case of automatic weapons, the vibrations are extremely intense. In these environments, an uninterrupted source of light is desirable.

Flashlights producing an uninterrupted source of light arc also desirable in other settings having similar harsh operating conditions, including subjection to vibration. In settings such as mining, construction, and manufacturing there may be a need for an uninterrupted and targeted light source. For instance, a reciprocating saw may be used to cut construction materials in poorly lit areas. Some prefer to have a light source illuminating the cutting surface, thereby making the cutting surface easier to see. A flashlight attached to the reciprocating saw will undergo vibration possibly causing the attached light source to flicker, leading to increased chance of operator error and bodily injury. Other applications, including vehicles such as cars, trucks, and motorbikes may have a need for an uninterrupted light source to improve visibility. Consequently, it is desirable for any flashlight attached to or near equipment that is subjected to such harsh operating conditions to provide an uninterrupted source of light and resist the detrimental effects of vibration.

Generally, lights attached to firearms typically include a housing that is formed of a body section and a head section. The head section typically houses a lens, a reflector, and a lamp assembly. These may be secured in the head section by a lens ring that is threadingly engaged with the head section. The body section typically houses a power source such as batteries for energizing the lamp. A switch assembly to control the operation of the lamp is also provided either on the light or on the firearm.

Currently, flashlight designs have certain disadvantages when the light undergoes heavy vibration, which is experienced by the light when attached to a firearm and in other settings where vibration is experienced. The electrical circuit in a flashlight typically includes several points of electrical contact between various components of the flashlight. The integrity of the circuit is dependent on the mating of each point of contact. For example, under heavy vibration the electrical contacts may be momentarily lost thus causing the light to flicker. Even worse, extreme vibration may result in the breakage of a light bulb and an interruption in light. A flickering light, or interrupted source of light, is undesirable and can impair efforts of law enforcement personnel and possibly make the difference between a successful operation and an unsuccessful one.

Thus, there is a need to provide a light source having improved operation when exposed to vibration.

SUMMARY

The present invention overcomes the drawbacks of prior flashlights and the electrical circuits used therein by providing a flashlight with an improved electrical circuit having a point of electrical contact between a lamp assembly and the head section as part of the electrical circuit. Prior flashlights have included a point of electrical contact between a lamp assembly and the head section as part of the electrical circuit. An example is shown in detail in a commonly owned U.S. patent application Ser. No. 08/738,858 incorporated by reference herein, where an electrical contact exists between the lamp assembly and the head section of the flashlight. A lens ring is used to hold the lamp assembly in close contact to the head section to provide a point of electrical contact. This point of contact, as well as other points of contact, is prone to electrical interruption during vibration and may result in undesirable flicker. The present invention includes the use of an electrically conducting contact spring to establish a continuous electrical contact point between the lamp assembly and the head section.

The contact springi, maintains an electrical connection between the head section and the lamp assembly even when the flashlight is subjected to vibration. The head section preferably includes an electrically conducting annular channel that may be found in an extension of the head section. The contact spring is preferably placed in the electrically conducting annular channel. In operation, the use of the contact spring maintains an uninterrupted electrical contact point between the head section and the lamp assembly within the electric circuit and eliminates or reduces the undesirable flicker.

Furthermore, the contact spring absorbs vibration and protects the lamp assembly from vibration that would otherwise be transferred from the head section to the lamp assembly. Thus, the contact spring prevents damage to the lamp assembly, which can lead to a reduced lamp life, a broken lamp, a cracked lens, or a pennanently disabled circuit.

Additionally, an embodiment of the present invention eliminates a contact point within the power source by effectively joining two voltage sources commonly used to power the circuit. The power source, typically two voltage sources in series, are assembled in an embodiment such that only one positive and one negative voltage output contact point are necessary to provide power to the circuit, thereby reducing flicker. By eliminating this contact point, a point of potential electrical interruption, further reduction in flicker is provided.

BRIEF DESCRIPTION OF THE DRAWINGS

Preferred embodiments of the present invention are described with reference to the following drawings, wherein.

DETAILED DESCRIPTION OF PREFERRED EMBODIMENTS

Figure 1:
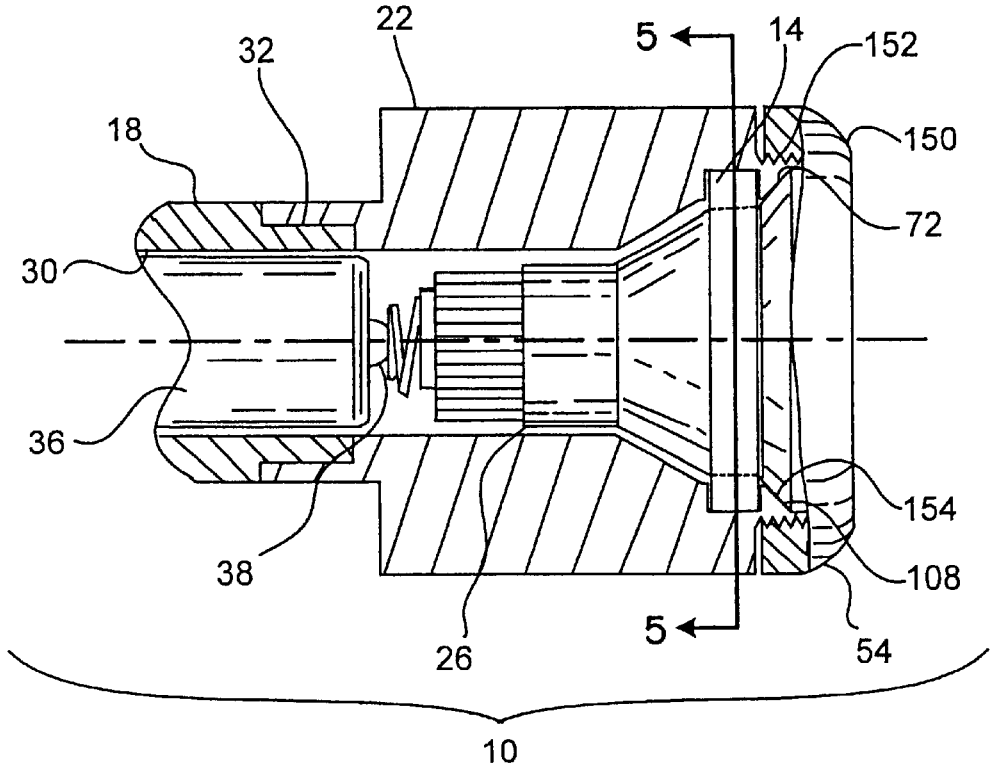
FIG. 1 is a cut-away side view of a flashlight with a contact spring of the present invention.

Referring to FIG. 1, a flashlight 10 with contact spring 14 is shown. The flashlight 10 is generally comprised of a body section 18, a head section 22, and a lamp assembly 26. The body section 18 is designed to holise a power source 36 and is characterized by a barrel section 30 having a first end 32. The barrel section 30, for example, may be provided with external or internal threads (not shown) at the first end 32. Such threads may be used in mating the body section 18 to the head section 22. The barrel section 30 preferably houses a power source 36 to provide current flow to the lamp assembly 26. The power source 36 is often provided in the form of energy cells, for instance alkaline or lithium batteries, although any suitable power source may be use.

The power source 36 may be made up of one or more energy cells. Preferably, a power source 36 having two or more energy cells is coupled together thus providing a power source 36 having one exposed positive contact 38 and one exposed negative contact (not shown). The energy cells are preferably coupled together by a shrink-wrap in a conventional manner such that the multiple energy cells are packaged together to provide a power source 36 having an exposed positive contact 38 and an exposed negative contact.

Figure 2:
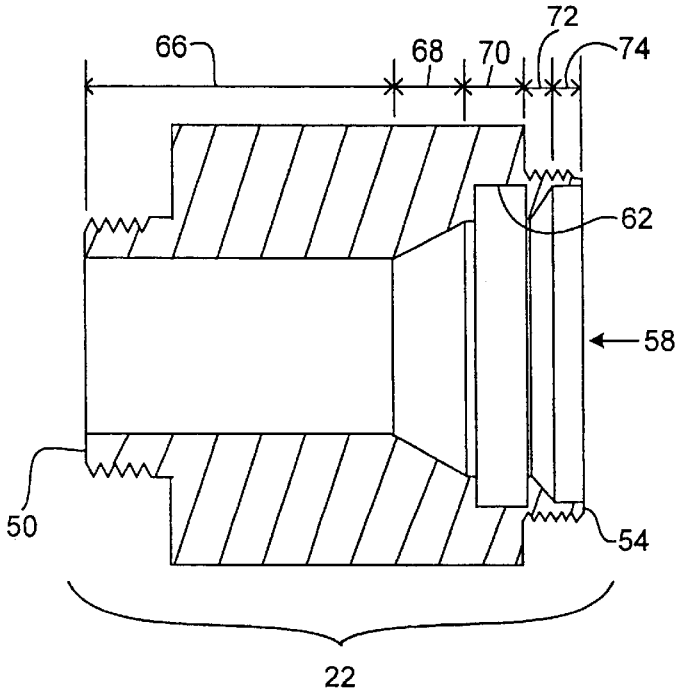
FIG. 2 is a cut-away side view of the head section shown in FIG. 1.

The head section 22 is shown in greater detail in FIG. 2. Head section 22 has a first end 50, a second end 54, and a through bore 58. Head section 22 further includes an annular groove 62 positioned on an inner surface of the through bore 58. The first end 50 is preferably provided with external or internal threads to provide a means to connect the head section 22 to other seclions or housings, such as engagement to a body section 18. Head section 22 may be characterized as having five integral sections with respect to its internal construction. Head section 22 includes a first section 66 having a generally constant internal diameter extending from first end 50 to second section 68. Second section 68 has a tapered, increasing internal diameter extending from first section 66 to third section 70. Third section 70 has a generally constant internal diameter extending frotr second section 68 to fourth section 72. Third section 70 includes an annular groeve 62 on the inner surface thereof. In a preferred embodiment, the annular glroove is machined using conventional machining techniques, although the head section, including the annular groove could be cast or molded as desired. Fourth section 72 has a tapered, increasing internal diameter extending from third section 70 to fifth section 74. Finally, fifth section 74 has a generally constant internal diameter and extends from fourth section 74 to the second end 54 of the head section 22.

Figure 3:
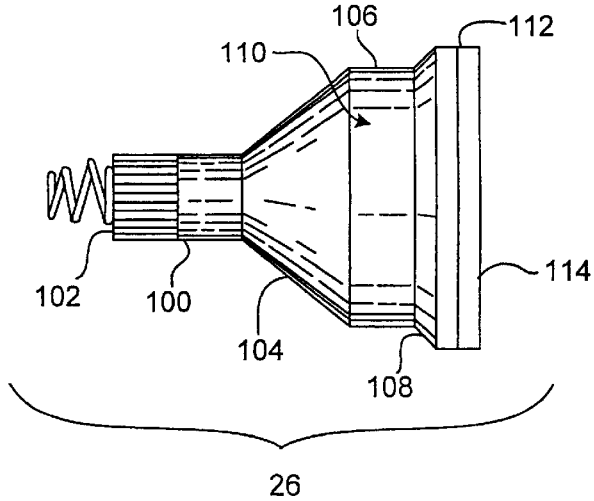
FIG. 3 is a side view of the lamp assembly shown in FIG. 1.

The lamp assembly 26 is shown in FIG. 3. Lamp assembly 26 may be characterized by 5 separate sections with respect to its external construction. Lamp assembly 26 includes a first section 100 having a generally constant external diameter extending from first end 102 to second section 104. Second section 104 has a tapered, increasing external diameter extending from first section 100 to third section 106. Third section 106 has a generally constant external diameter extending from second section 104 to the fourth section 108. Third section 106 has an electrically conducting exterior 110. Fourth section 108 has a tapered, increasing external diameter extending from third section 106 to fifth section 112. Finally, fifth section 112 has a generally constant external diameter and extends from fourth section 108 to the second end 114. The external construction of the lamp assembly 26 generally corresponds to the internal construction of the head section 22. For example. after the lamp assembly 26 is placed within the head section 22 the first section 100 of the lamp assembly is preferably near the first section 66 of the head section 22 such that the first end 102 of the lamp assembly 26 is in close proximity to the first end 50 of the head section. The external construction of the lamp assembly 26 is provided as an exemplary embodiment only and may be of any suitable construction or tailored to accommodate specific space and design requirements of the head section 22.

Figure 4:
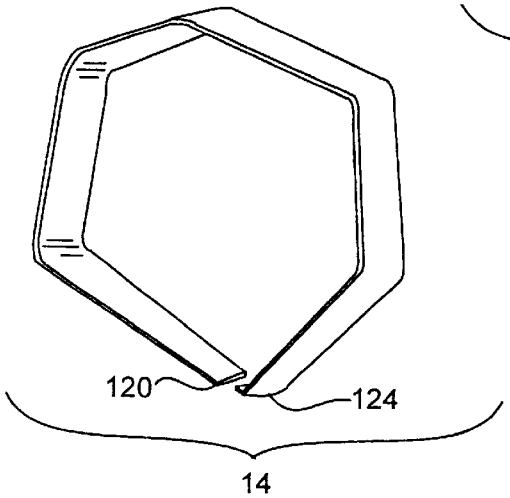
FIG. 4 is a perspective view of the contact spring shown in FIG. 1.

An exemplary embodiment of the contact spring 14 is shown in FIG. 4. Contact spring 14 is comprised of an electrically conducting medium such as copper. As illustrated in FIG. 4, the contact spring 14 preferably is annular in form. That is, the contact spring 14 has a generally circular shape similar to that of a circle, triangle, square or any combination thereof such as a hexagon, pentagon, or octagon. Contact spring 14 may have two ends, a first end 120 and a second end 124, such that the two ends 120 and 124 do not meet.

Figure 5:
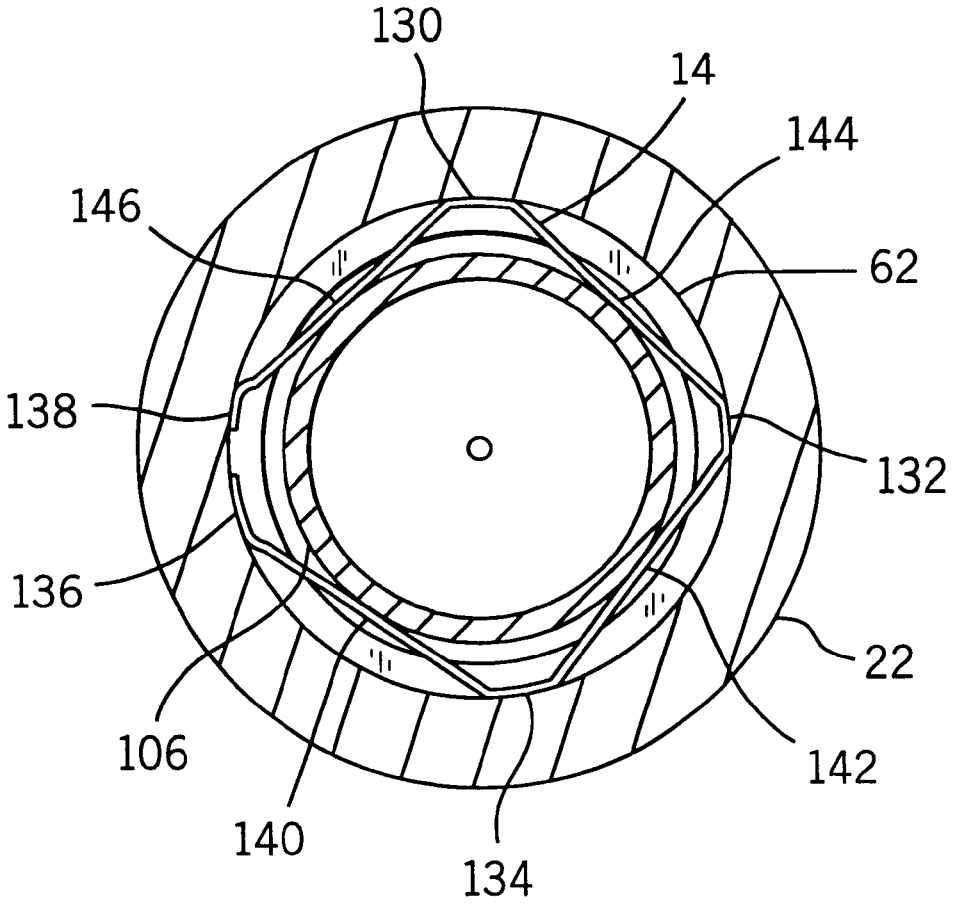
FIG. 5 is a cut-away axial view of the flashlight along line A—A of FIG. 1.

As shown in FIGS. 1 and 5, the contact spring 14 provides electrical contact between the head section 22 and the lamp assembly 26 FIG. 5 illustrates a cross section of the flashlight 10 in FIG. 1 along line AA. The contact spring 14 typically forms multiple electrical contact points such as at 130, 132, 134, 136, and 138 within the annular groove of the head section 22. The contact spring also contacts the outer surface of the lamp assembly 26 at section 106 at parts 140, 142, 144, and 146. More or less electrical contacts may be generated between the lamp assembly 26 and the head section 22 depending on the specific geometry the contact spring 14 (i.e., octagon, square, etc.). Electric current preferably flows from the power source 36 to the lamp assembly 26 and ultimately to the light emitting device (not shown) such as a bulb or an LED(s). The electrical current then preferably flows from the light emitting device through the lamp assembly 26 through the contact spring 14 through the head section 22 directing the current back to the power source completing the electrical circuit and ultimately providing a current path. Contact spring 14 provides an electrical cun-ent path between the lamp assembly 26 and the head section 22.

Contact spring 14 may provide additional protection to the lamp assembly 26 by absorbing the vibration that would otherwise be transferred from the head section 22 to the lamp assembly 26. Preferably having a contact spring 14 made of a forgiving material such as copper, allows the contact spring 14 to flex to accommodate relative movement of the lamp assembly 26 within the head section 22 to dampen the vibrations.

Contact spring 14 may be used to physically suspend the lamp assembly 26 within the head section 22. Such suspension may prevent further vibrations from reaching the lamp assembly 26 while preferably maintaining electrical contact between the head section 22 and the lamp assembly 26, as shown in FIG. 1. Additionally one or more contact springs 14 may be used to suspend or provide electrical contact between the lamp assembly 26 and the head section 22.

Referring to FIG. 1, the lamp assembly 26 disposed within the head section 22 is preferably held within the head section 22 by a lens ring 150 securing the second end (114 in FIG. 3) of the lamp assembly 26 near the second end 54 of the head section 22. The lens ring 150 may be provided with internal threads 152 to threadingly engage with the external threads at the second end 54 of the head section 22. When lens ring 150 is screwed onto the head section 22, the fourth section 108 of the lamp assembly 26 is preferably pressed against the fourth section 72 of the head section 22. Thus an additional electrical contact 154, providing a current path, may be established between the lamp assembly 26 and the head section 22. Alternative methods to position the lamp assembly 26 within the head section 22 may be used. As one example, the lamp assembly 26 may have a threaded exterior used to threadingly engage itself to the head section.

Figure 6:
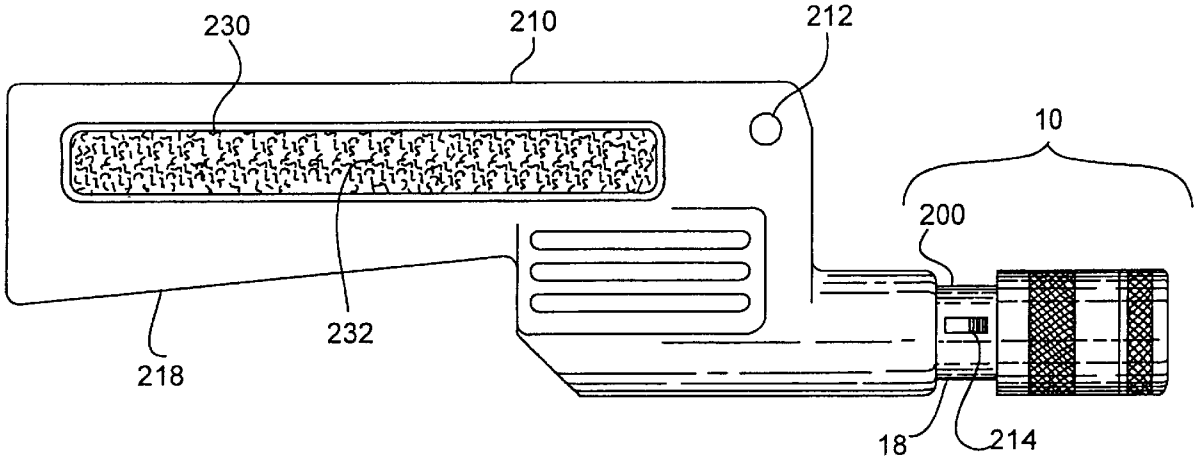
FIG. 6 is a side view of the flashlight with a firearm support of the present invention.

Referring to FIG. 6, a flashlight 10 with a body section 18 adapted for mounting to a firearm is shown. The body section 18 includes a surface 200 that may be mounted to a firearm support 210. The firearm support 210 has a pin aperture 212 used to support a pin for mounting the firearm support 210 to a barrel of a firearm. A variety of techniques may be used to mount the body section 18 to the firearm support 210. For example, the body section 18 may be threadingly engaged with the firearm support 210, glued, or fastened by screws or the like. Flashlight 10 may also be "snapped" into the firearm support 210 to provide a quick release mechanism to disengage the flashlight 10 from the firearm support 210. Flashlight 10 and firearm support 210 shown in FIG. 2 are particularly well suited for use with the MP-5 firearm. Tests have shown that the disclosed flashlight significantly reduces or eliminates undesirable flicker during discharge.

The firearm support 210 may be constructed out of plastic, metal or both, and may be attached to a firearm, for example on the barrel of a gun (not shown). A switch 214, for enabling current flow from the power source (36 in FIG. 1) to the lamp assembly (26 in FIG. 1) may be placed on the body section 18 of the flashlight 10. The firearm support 210 may include a gripping surface 218 used to hold the firearm. A switch 230 may also be situated on the firearm support 210 such that the switch 230 enables current flow from the power source (36 in FIG. 1) to the lamp assembly (26 in FIG. 1). Switch 230 is generally comprised of a conducting aim (not shown) and an elastic sleeve 232. The elastic sleeve 232 covers the switch 230 and is adapted to be squeezed and pressed inwardly to bend the conducting arm to complete an electrical connection between a power source (36 in FIG. 1) and the lamp assembly (26 in FIG. 1) enabling current flow from the power source (36 in FIG. 1) to the lamp assembly (26 in FIG. 1).

Figure 7:
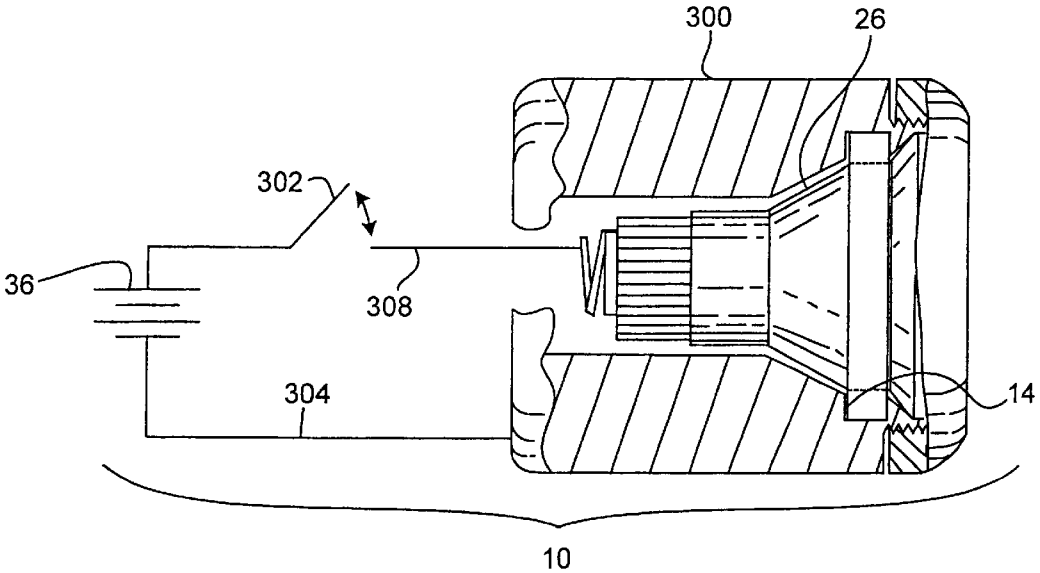
FIG. 7 is a side view of a flashlight with a contact spring and a annular groove of the present invention.

Referring to FIG. 7, a flashlight 10 with the contact spring 14 of the present invention is shown. Flashlight 10 may be suitably mounted in any environment where vibration may be encountered or where improved vibration resistance is desired. Flashlight 10 is generally comprised of a housing 300, a power source (modeled in FIG. 7 as a voltage source 36), a switch 302, and a lamp assembly 26. A contact spring 14 is included between the lamp assembly 26 and housing 300. When the switch 302 is enabled, current flows through the lamp assembly 26 to the bulb of the lamp assembly 26, through the lamp assembly 26 through the contact spring 14 through the housing 300 and through the voltage source 36. The voltage source 36 may be placed away from the housing 300 perhaps having an electrical cord connecting the two. The electrical cord may be constructed of two conducting wires preferably surrounded in an electrical insulator. The two wires provide a current path to 308 and from 304 the housing 300. The switch 302 may be located anywhere in the electrical circuit such as near the voltage source 36 or on the housing 300.

While the invention has been described in connection with certain embodiments, it should be understood that it is not intended to limit the invention to these particular embodiments. To the contrary, it is intended to cover all alternatives, modifications and equivalents falling within the spirit and scope of the invention.

We claim:

1. A flashlight having improved vibration resistance comprising:

a body section;

a head section attached to the body section;

a power source located within the body section;

a lamp assembly positioned in the head section, and in electrical contact with the power source;

a groove positioned on the inner surface of the head section; and a contact spring located within the groove, providing electrical contact between the head section and the lamp assembly.

2. The flashlight of claim 1, further including a switch electrically connected to the power supply to enable cunent flow between the lamp assembly and the head section through the contact spring.

3. The flashlight of claim 1, wherein the body section includes a surface adapted for attachment to a firearm.

4. The flashlight of claim 1, wherein the head section threadingly engages the body section.

5. The flashlight of claim 1, wherein the power source comprises an at least two coupled energy cells.

6. The flashlight of claim 1, wherein the lamp assembly has an electrically conducting exterior in electrical contact with the contact spring.

7. The flashlight of claim 1, further comprising a Icns ring, wherein the lens ring encloses the lamp assembly within the head section.

8. The flashlight of claim 1, wherein the groove includes an electrically conducting surface in electrical contact with the contact spring.

9. The flashlight of claim 1, wherein the head section includes an extension for positioning of the groove.

10. The flashlight of claim 1, wherein the contact sprng is readily removable from the grove.

11. The flashlight of claim 1, wherein the contact spring comprises copper.

12. The flashlight of claim 1, wherein the body section is adapted for mounting to a firearm.

13. The flashlight of claim 1, wherein the flashlight is mounted to a firearm support.

14. The flashlight of claim 13, wherein the firearm support is provided with a gripping surface.

15. The flashlight of claim 13, wherein a switch is positioned on the firearm support enabling current flow to the lamp assembly.

16. The flashlight of claim 15, wherein the switch is activated by squeezing a portion of a gripping surface on the firearm support.

17. A flashlight having improved vibration resistance comprising:

a power source;

a housing in electrical contact with the power source;

a lamp assembly positioned in the housing, and ir electrical contact with the power source;

a groove positioned on an inner surface of the housing; and a contact spring located within the groove providing an electrical connection between the lamp assembly and the housing.

18. The flashlight of claim 17, wherein the contact spring absorbs vibration transferred from the housing to the lamp assembly.

19. The flashlight of claim 17, wherein the contact spring physically suspends the lamp assembly within the housing.

20. The flashlight of claim 17, wherein the contact spring is readily removable from the groove.

21. The flashlight of claim 17, wherein the electrical contact between the power source and the housing comprises an electrically conducting cord.

* * * * *